US011378320B2

(12) United States Patent
Saito et al.

(10) Patent No.: US 11,378,320 B2
(45) Date of Patent: Jul. 5, 2022

(54) ICE MAKER

(71) Applicant: NIDEC SANKYO CORPORATION, Nagano (JP)

(72) Inventors: Shunji Saito, Nagano (JP); Katsuhiko Hayashi, Nagano (JP)

(73) Assignee: NIDEC SANKYO CORPORATION, Nagano (JP)

( * ) Notice: Subject to any disclaimer, the term of this patent is extended or adjusted under 35 U.S.C. 154(b) by 12 days.

(21) Appl. No.: 16/589,149

(22) Filed: Oct. 1, 2019

(65) Prior Publication Data

US 2020/0103156 A1 Apr. 2, 2020

(30) Foreign Application Priority Data

Oct. 2, 2018 (JP) ..... JP2018-187428

(51) Int. Cl.
*F25C 1/10* (2006.01)
*F25C 5/04* (2006.01)

(52) U.S. Cl.
CPC . *F25C 1/10* (2013.01); *F25C 5/04* (2013.01)

(58) Field of Classification Search
CPC ..... F25C 1/10; F25C 5/04; F25C 1/04; F25C 2305/022; F25C 5/06; F25D 23/067; F25D 2400/40; F25D 23/12
USPC ..... 62/345
See application file for complete search history.

(56) References Cited

U.S. PATENT DOCUMENTS

423 A * 10/1837 Brittain ..... D01B 1/22 19/31
2,407,058 A * 9/1946 Clum ..... F25C 1/04 62/157
2,717,504 A * 9/1955 Knerrcarlj ..... F25C 5/187 62/157
2,846,854 A * 8/1958 Galin ..... F25C 1/04 62/526
2,891,385 A * 6/1959 Nelson ..... F25C 1/04 62/137
2,996,895 A * 8/1961 Lippincott ..... F25C 1/04 62/340
3,056,271 A * 10/1962 De Turk ..... F25C 5/06 62/353
3,200,600 A * 8/1965 Elfving ..... H01L 35/30 62/344

(Continued)

FOREIGN PATENT DOCUMENTS

CN 207065951 3/2018
CN 207335251 5/2018

(Continued)

*Primary Examiner* — Eric S Ruppert
*Assistant Examiner* — Kirstin U Oswald
(74) *Attorney, Agent, or Firm* — JCIPRNET

(57) ABSTRACT

To provide an ice maker capable of suppressing damage to a frame.

In an ice maker, an ice making tray, and a driving unit structured to cause the ice making tray to perform a flip operation and a twist operation are supported by a frame. With the frame, in an inner wall of a first side plate unit, there are provided a first inner wall portion extending in a first direction along the driving unit, and a second inner wall portion extending in the first direction along the ice making tray on the other side in a second direction with respect to the first inner wall portion, and in a step unit connecting the first inner wall portion and the second inner wall portion, there is provided a cutout serving as a through unit for passing a wire connected to the driving unit.

7 Claims, 6 Drawing Sheets

(56) References Cited

U.S. PATENT DOCUMENTS 3,200,612 A * 8/1965 Frohbieter ..... F25C 1/04 62/345
3,383,876 A * 5/1968 Frohbieter ..... F25C 5/14 62/137
3,580,009 A * 5/1971 Snow ..... F25C 1/04 62/353
3,648,964 A * 3/1972 Fox ..... F25C 1/04 249/127
3,677,030 A * 7/1972 Nicholas ..... F25C 1/04 62/353
3,775,992 A * 12/1973 Bright ..... F25C 1/24 62/73
3,871,189 A * 3/1975 Ohnishi ..... F25C 5/06 425/440
3,952,539 A * 4/1976 Hanson ..... F25C 1/24 62/351
4,492,017 A * 1/1985 Latter ..... F16B 21/00 29/434
5,400,605 A * 3/1995 Jeong ..... F25C 1/04 62/353
2005/0160757 A1* 7/2005 Choi ..... F25C 1/10 62/344
2006/0032262 A1* 2/2006 Seo ..... F25C 5/06 62/340
2006/0117784 A1* 6/2006 Yang ..... F25C 5/08 62/340
2010/0205996 A1 8/2010 Ducharme et al.
2012/0023996 A1* 2/2012 Herrera ..... F25C 1/04 62/340
2012/0180504 A1* 7/2012 An ..... F25C 5/06 62/71
2012/0240613 A1* 9/2012 Saito ..... F25C 5/187 62/379
2013/0047645 A1* 2/2013 Kim ..... F25C 1/04 29/890.035
2013/0291583 A1* 11/2013 Bauman ..... F25C 1/10 62/340
2014/0130537 A1* 5/2014 Gu ..... F25D 25/025 62/344
2016/0116198 A1* 4/2016 Becker ..... F25C 5/182 62/344
2016/0138844 A1* 5/2016 Boarman ..... F25C 1/10 62/3.63
2016/0201965 A1* 7/2016 Abeygunawardana ... F25C 5/08 62/349
2016/0252286 A1* 9/2016 Jeong ..... F25C 1/04 62/130
2017/0336124 A1* 11/2017 Visin ..... F25C 1/243
2018/0017307 A1* 1/2018 Jeong ..... F25C 1/18

FOREIGN PATENT DOCUMENTS

CN 207907560 9/2018
JP 2011089758 5/2011
JP 2015132448 7/2015

* cited by examiner

ICE MAKER

CROSS REFERENCE TO RELATED APPLICATION

The present application claims priority under 35 U.S.C. § 119 to Japanese Application No. 2018-187428 filed Oct. 2, 2018, and the entire content of which is incorporated herein by reference.

BACKGROUND

Field of the Invention

The present invention relates to an ice maker in which a driving unit causes an ice making tray to perform a flip operation and a twist operation.

Description of the Related Art

In an ice maker installed in a refrigerator, a water storage concave unit of an ice making tray is filled with water from a water supply tank through a water supply pipe, and when ice making is completed, a driving unit flips the ice making tray around an axis extending in a first direction and then twists the ice making tray, so that the ice is dropped into an ice storage container. Here, the driving unit is arranged on one side in the first direction with respect to the ice making tray, and is supported by a common frame together with the ice making tray. The frame has a first side plate unit and a second side plate unit on both sides in a second direction (width direction) intersecting the first direction of the ice making tray. An ice detecting lever is arranged between the second side plate unit of the frame and the ice making tray, and the first side plate unit is fixed to the refrigerator main body when the ice maker is installed in the refrigerator. The driving unit uses a motor as a drive source, and is supplied with power via a wire drawn from the driving unit to the outside of the frame.

In ice makers described in Japanese Unexamined Patent Application Publication No. 2011-89758 and 2015-132448, if a wire is not supported by a frame and is directly drawn out from a driving unit to the outside of the frame, handling of the wire takes a lot of time and effort. Therefore, it is conceivable to provide a wire support structure in a first side plate unit. For example, when a through unit is provided in the first side plate unit and the wire is routed through the through unit, the midway portion of the wire is supported by the through unit.

However, in an ice maker of the type in which the driving unit causes an ice making tray to perform a twist operation, a large force is applied to the frame when the driving unit causes the ice making tray to perform the twist operation. Thus, if the through unit is formed in the first side plate unit, stress is concentrated on the vicinity of the through unit of the first side plate unit, which may damage the first side plate unit. Further, if an attachment unit for attaching the ice maker to a support is provided in the first side plate unit, the force applied to the frame when the ice making tray is caused to perform the twist operation concentrates on a connection portion between the attachment unit and the first side plate unit, which may damage the connection portion.

SUMMARY

To solve the above problems, an ice maker according to at least an embodiment of the present invention includes: an ice making tray including a water storage concave unit arranged to face upward; a driving unit arranged on one side in a first direction intersecting an up-down direction with respect to the ice making tray, the driving unit being structured to cause the ice making tray to perform a flip operation and a twist operation around an axis extending in the first direction; a frame structured to support the ice making tray and the driving unit; and a wire passing through a through unit of the frame from the driving unit and drawn out of the frame, wherein the frame includes a first side plate unit extending in the first direction on one side in a second direction intersecting the up-down direction and the first direction with respect to the ice making tray, and the first side plate unit includes an inner wall facing the other side in the second direction, the inner wall includes a first inner wall portion extending in the first direction along the driving unit, a second inner wall portion extending in the first direction along the ice making tray on the other side in the second direction with respect to the first inner wall portion, and a step unit extending in a direction intersecting the first direction to connect the first inner wall portion and the second inner wall portion, and the through unit is provided in the step unit.

In at least an embodiment of the present invention, the through unit is provided in the first side plate unit of the frame structured to support the ice making tray, and the wire connected to the driving unit is passed through the through unit and drawn out of the frame. The step unit is provided on the inner wall of the first side plate unit, and the through unit is provided in the step unit. Therefore, the thickness of the first side plate unit in the second direction can be increased by a thickness corresponding to the step unit provided on the inner wall, thereby making it possible to secure the strength of the first side plate unit. Therefore, deformation or damage of the frame can be suppressed. Further, since the step unit intersects the direction (first direction) in which the first side plate unit extends, the through unit can be provided to penetrate the first side plate unit in the first direction. As a result, when the wire is drawn out from the inside to the outside of the frame through the through unit, the wire can be drawn out without being greatly bent.

In at least an embodiment of the present invention, it is preferable that the step unit is located on the one side in the second direction at a coupling position where the driving unit and the ice making tray are coupled to each other. With this arrangement, the first side plate unit has a portion on the ice making tray side with respect to the coupling position with an increased thickness in the second direction, thereby making it possible to secure the strength of the first side plate unit and suppress damage to the first side plate unit accordingly. Further, since the thickness of the first side plate unit can be increased by utilizing an empty space around the ice making tray, securing the strength of the first side plate unit makes it possible to prevent the size of the ice maker in the second direction from increasing.

In at least an embodiment of the present invention, it is preferable that the first side plate unit includes an outer wall facing the one side in the second direction, the outer wall includes a plurality of reinforcing ribs protruding to the one side in the second direction, the through unit is provided in a gap between the reinforcing ribs, and tip end faces of the plurality of reinforcing ribs are located on a same plane, and the tip end faces are an attachment flat surface structured to abut against a support structured to support the ice maker. With this arrangement, the strength of the first side plate unit can be secured by the reinforcing ribs, and a space for drawing the wire can be secured in the gap between the reinforcing ribs. Further, the ice maker can be attached to the support with the tip end faces (attachment flat surfaces) of the reinforcing ribs coming into contact with the support. That is, the ice maker can be attached such that the first side plate unit is supported by the support. Thus, the deformation and damage of the first side plate unit can be suppressed.

In at least an embodiment of the present invention, it is preferable that the driving unit flips the ice making tray from a water storage position where the water storage concave unit faces upward to an ice removal position where the water storage concave unit faces downward, and vice versa, and the ice removal position is a position such that an opening direction of the water storage concave unit faces an opposite side to a side on which the first side plate unit is located. With this arrangement, the side on which an ice is dropped from the ice making tray can be opposite to the side on which the wire is drawn (that is, the side on which the first side plate unit is located).

In at least an embodiment of the present invention, it is preferable that the ice making tray is made of a flexible material, and the frame includes an abutment unit structured to abut against the ice making tray from the side on which the first side plate unit is located when the ice making tray is flipped around the axis to reach the ice removal position from the water storage position and to prevent rotation of the ice making tray. With this arrangement, when the ice making tray is moved to the ice removal position to remove the ice, a force applied from the ice making tray to the frame is a force to press the first side plate unit against the support. Therefore, the first side plate unit can be supported by the support, thereby making it possible to suppress deformation and damage of the first side plate unit.

In at least an embodiment of the present invention, the frame includes a second side plate unit extending in the first direction on the other side in the second direction with respect to the ice making tray, and an ice detecting member supported to be movable in an up-down direction is arranged between the second side plate unit and the ice making tray. With this arrangement, the wire can be drawn to an opposite side to a side on which an ice is dropped from the ice making tray (that is, the side on which the ice detecting member is arranged).

In at least an embodiment of the present invention, it is preferable that the through unit is a cutout provided at a lower end or an upper end of the first side plate unit. With this arrangement, a work of passing the wire through the through unit is easy.

According to at least an embodiment of the present invention, the through unit is provided in the first side plate unit of the frame structured to support the ice making tray, and the wire connected to the driving unit is passed through the through unit and drawn out of the frame. The step unit is provided on the inner wall of the first side plate unit, and the through unit is provided in the step unit. Therefore, the thickness of the first side plate unit in the second direction can be increased by a thickness corresponding to the step unit provided on the inner wall, thereby making it possible to secure the strength of the first side plate unit. Therefore, deformation or damage of the frame can be suppressed. Further, since the step unit intersects the direction (first direction) in which the first side plate unit extends, the through unit can be provided to penetrate the first side plate unit in the first direction. As a result, when the wire is drawn out from the inside to the outside of the frame through the through unit, the wire can be drawn out without being greatly bent.

BRIEF DESCRIPTION OF THE DRAWINGS

Embodiments will now be described, by way of example only, with reference to the accompanying drawings which are meant to be exemplary, not limiting, and wherein like elements are numbered alike in several Figures.

DETAILED DESCRIPTION

With reference to the drawings, at least an embodiment of the present invention will be described below.

(Overall Configuration)

Figure 1:
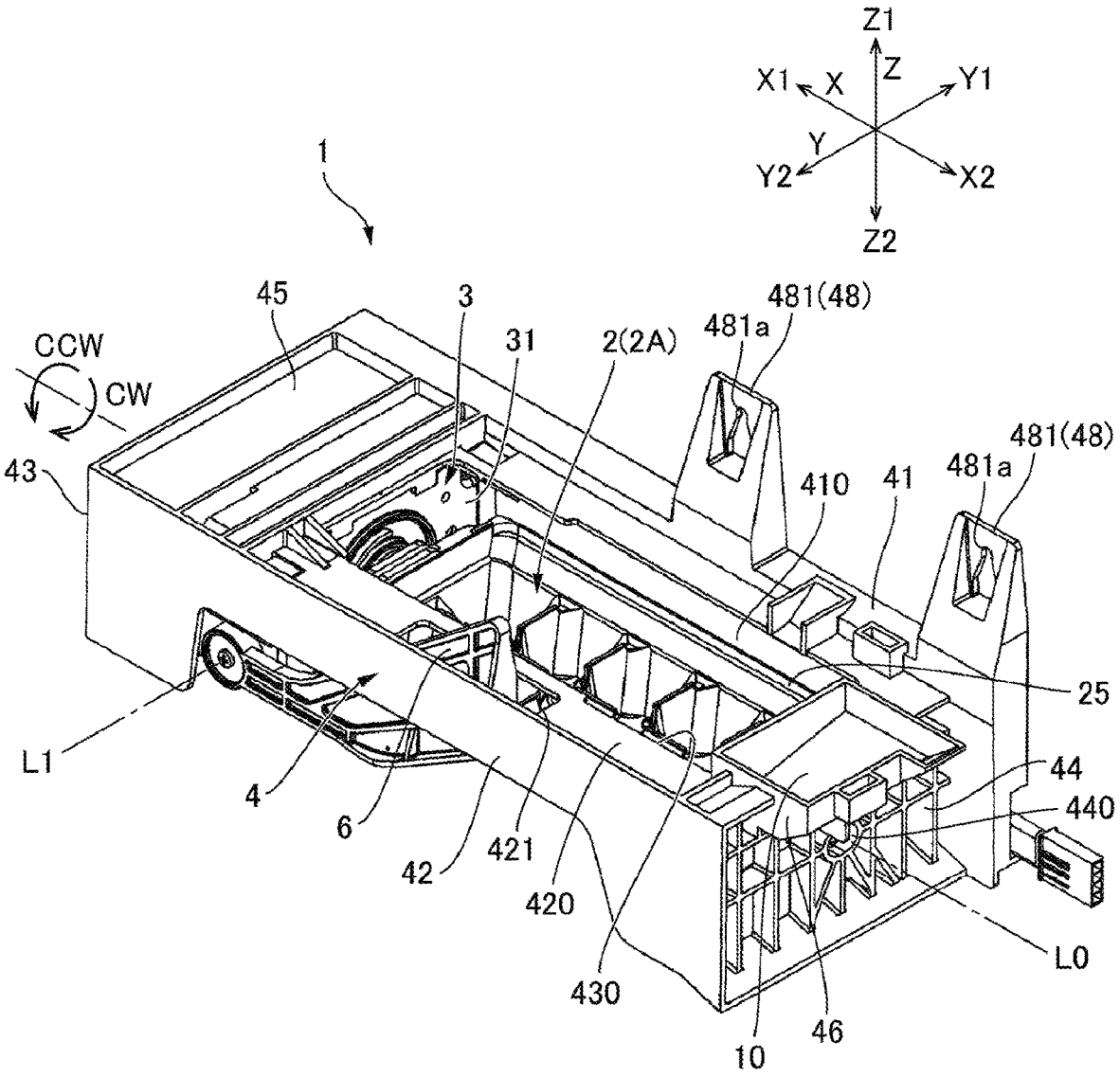
FIG. 1 is a perspective view of an ice maker to which at least an embodiment of the present invention is applied, as viewed on the side on which a second side plate unit is located and obliquely from above.
Figure 2:
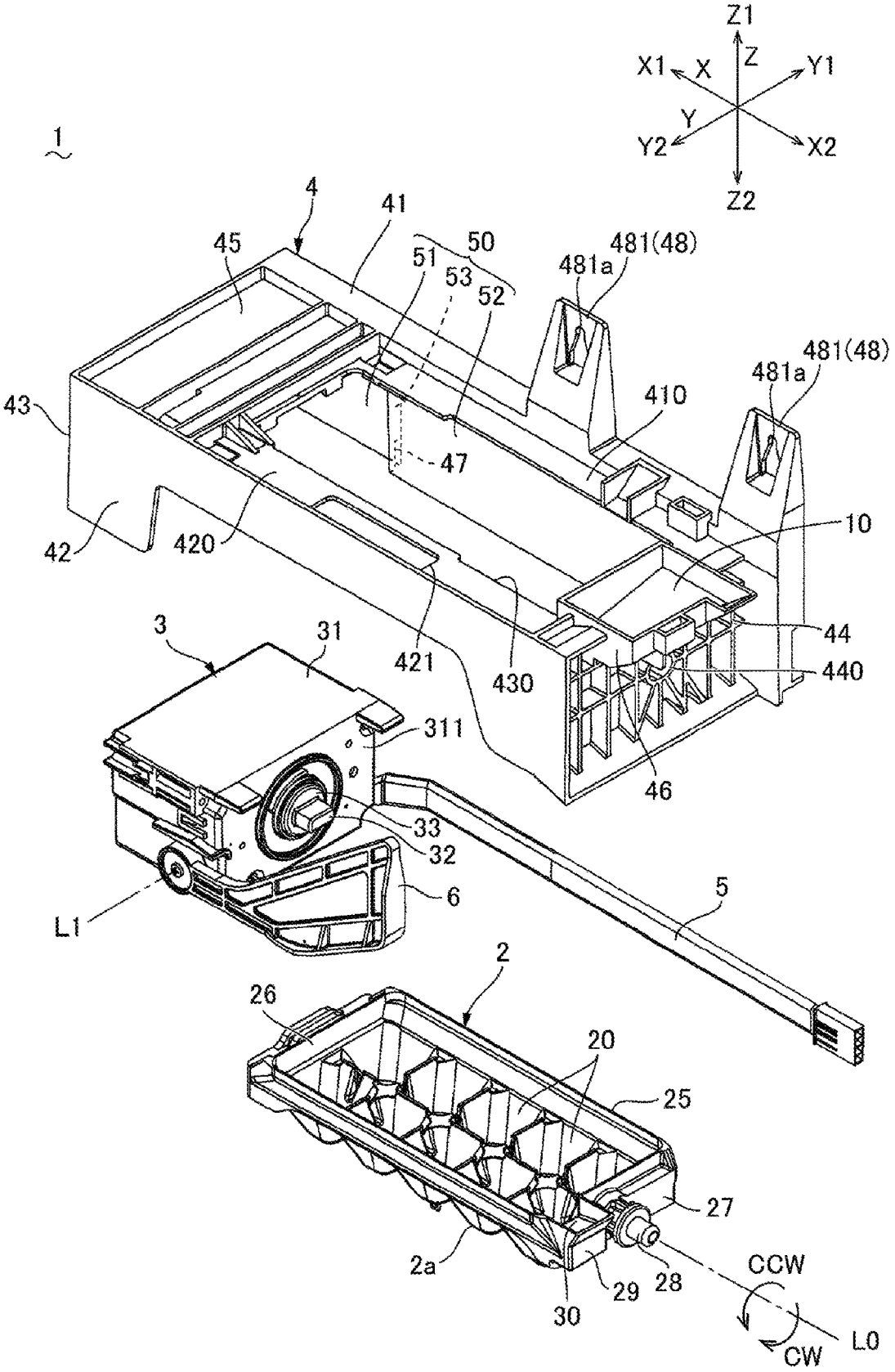
FIG. 2 is an exploded perspective view of the ice maker of FIG. 1, as viewed on the side on which the second side plate unit is located and obliquely from above.
Figure 3:
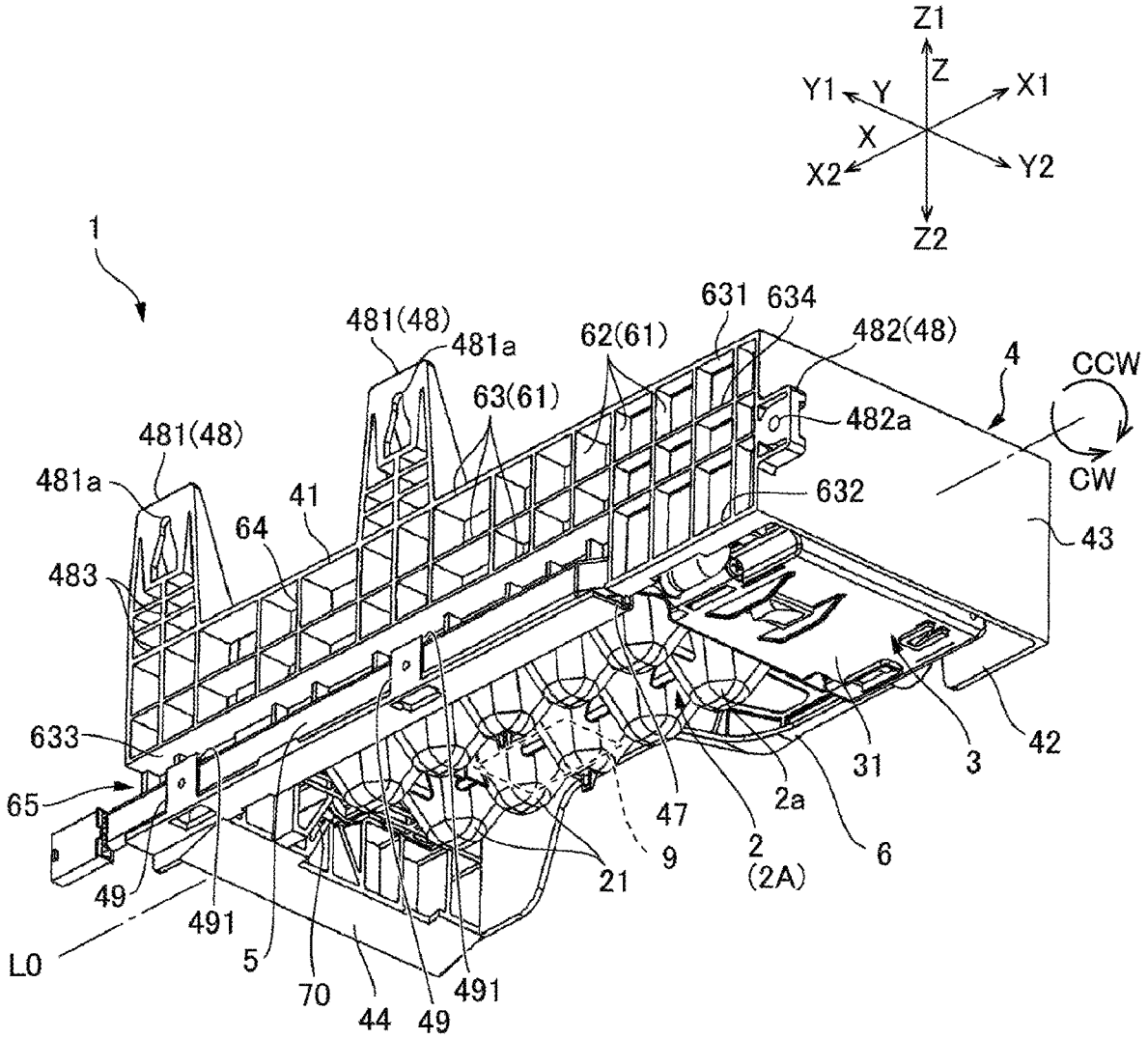
FIG. 3 is a perspective view of the ice maker with an ice making tray being at a water storage position, as viewed on a side on which a first side plate unit is located and obliquely from below.
Figure 4:
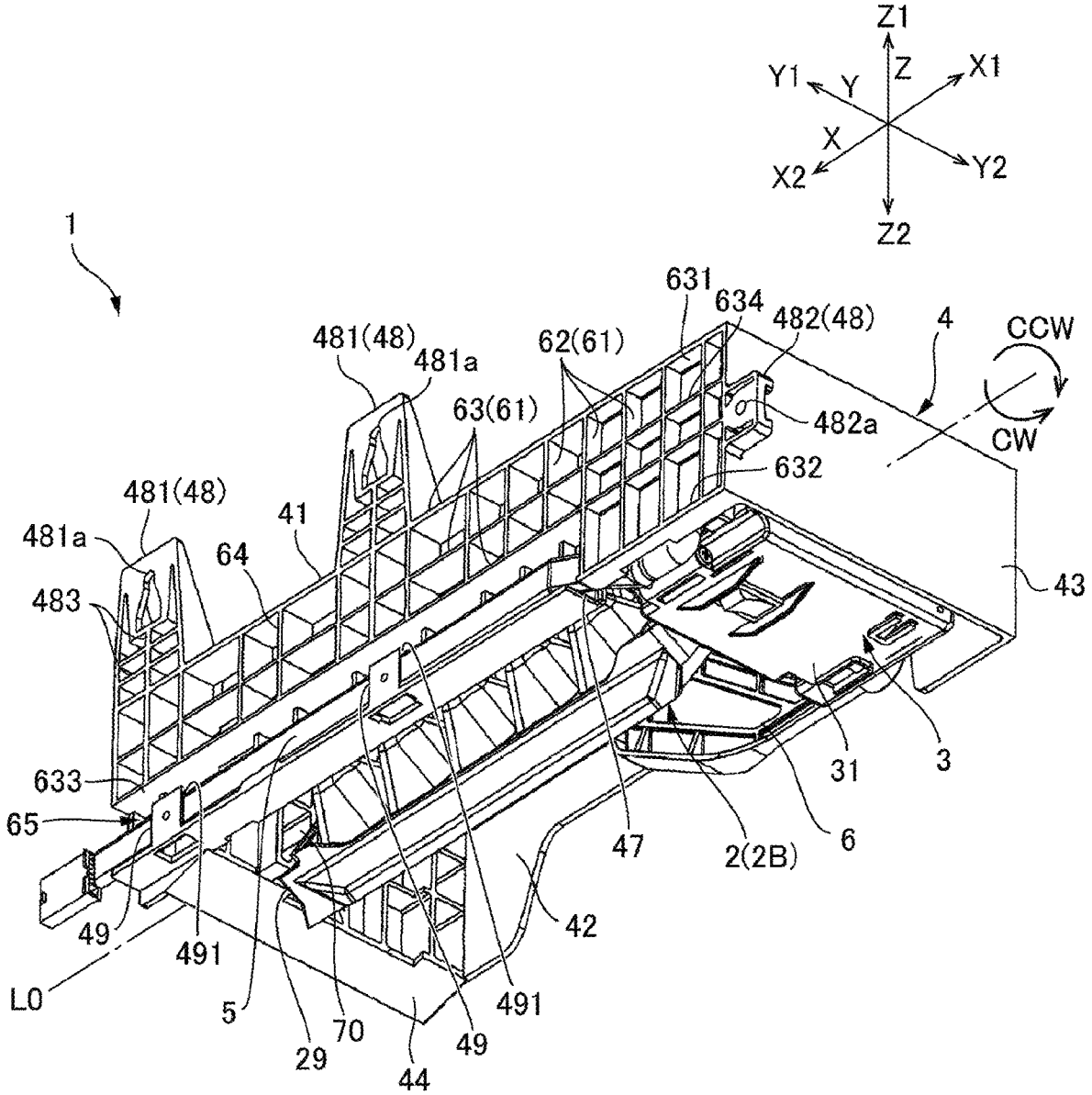
FIG. 4 is a perspective view of the ice maker with an ice making tray being at an ice removal position, as viewed on the side on which the first side plate unit is located and obliquely from below.
Figure 5:
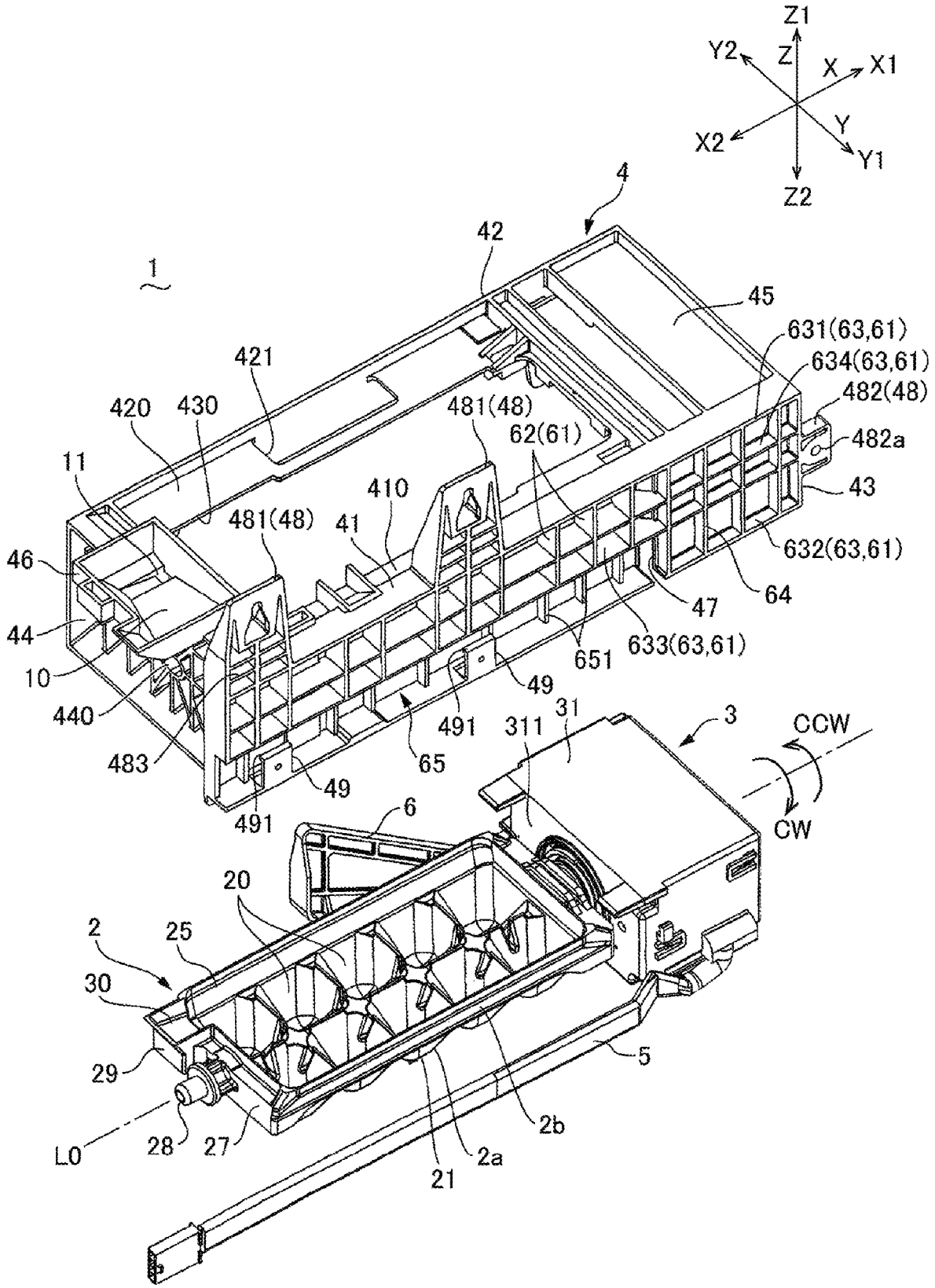
FIG. 5 is an exploded perspective view of the ice maker of FIG. 1, as viewed on the side on which the first side plate unit is located and obliquely from above.

FIG. 1 is a perspective view of an ice maker 1 to which at least an embodiment of the present invention is applied, as viewed on a side on which a second side plate unit 42 is located and obliquely from above. FIG. 2 is an exploded perspective view of the ice maker 1 of FIG. 1, as viewed on the side on which the second side plate unit 42 is located and obliquely from above. FIG. 3 is a perspective view of the ice maker 1 with an ice making tray 2 being at a water storage position 2A, as viewed on a side on which a first side plate unit 41 is located and obliquely from below. FIG. 4 is a perspective view of the ice maker 1 with the ice making tray 2 being at an ice removal position 2B, as viewed on the side on which the first side plate unit 41 is located and obliquely from below. FIG. 5 is an exploded perspective view of the ice maker 1 of FIG. 1, as viewed on the side on which the first side plate unit 41 is located and obliquely from above.

The ice maker 1 is installed in a refrigerator. As illustrated in FIG. 1, the ice maker 1 includes the ice making tray 2, a driving unit 3 structured to flip the ice making tray 2, and a frame 4 structured to support the ice making tray 2 and the driving unit 3. The ice making tray 2 has a substantially rectangular shape whose plane shape is long in a first direction X. The ice making tray 2 includes a plurality of water storage concave units 20 structured to store water supplied from a water supply pipe (not illustrated). The driving unit 3 flips the ice making tray 2 around an axis L0 passing in the longitudinal direction through a center portion in the shorter direction of the ice making tray 2. The ice maker 1 drops the ice of the ice making tray 2 into an ice storage container (not illustrated) by a flip operation and a twist operation of the ice making tray 2.

An output shaft 32 (see FIG. 2) of the driving unit 3 is coupled to an end portion on one side of the ice making tray 2 in the direction of the axis L0. Drive of the driving unit 3 rotates the ice making tray 2 from the water storage position 2A where the water storage concave units 20 face upward to the ice removal position 2B where the water storage concave units 20 face downward, and vice versa. In FIG. 1 and FIG. 3, the ice making tray 2 is arranged at the water storage position 2A. In FIG. 4, the ice making tray 2 is arranged at the ice removal position 2B.

As illustrated in FIG. 1 and FIG. 3, the ice maker 1 places the ice making tray 2 in the water storage position 2A and stores water supplied from the water supply pipe in the water storage concave units 20 of the ice making tray 2 to make ice. When the ice making is completed, as illustrated in FIG. 4, the ice maker 1 drives the driving unit 3 to flip the ice making tray 2 from the water storage position 2A to the ice removal position 2B, and drop the ice of the ice making tray 2 into an ice storage container (not illustrated) placed below the ice maker 1.

In the following description, three directions orthogonal to one another are referred to as the first direction X, a second direction Y, and a third direction Z. The first direction X is the direction of the axis L0 of the ice making tray 2. The third direction Z is an up-down direction in the installation posture of the ice maker 1 (the posture illustrated in FIG. 1). The second direction Y is a direction orthogonal to the direction of the axis L0 and the up-down direction. Further, in the first direction X, the side on which the driving unit 3 is located is referred to as one side X1, and the side on which the ice making tray 2 is located is referred to as the other side X2. In the third direction Z, the upper side is referred to as one side Z1 and the lower side is referred to as the other side Z2. Further, in the second direction Y, the direction in which the openings of the water storage concave units 20 face when the ice making tray 2 rotates around the axis L0 in a CCW direction (first rotation direction) from the water storage position 2A toward the ice removal position 2B is referred to as one side Y1, and the opposite side thereof is referred to as the other side Y2.

(Ice Making Tray)

The ice making tray 2 is made of an elastically deformable material (flexible material). In the present embodiment, the ice making tray 2 is made of a resin material. As illustrated in FIG. 2, the ice making tray 2 includes a substantially quadrangular frame unit 25 and the water storage concave units 20 arranged inside the frame unit 25. The water storage concave units 20 are arranged in five rows in the first direction X as pairs of two water storage concave units 20 arranged in the second direction Y. In a first wall unit 26 provided on one side X1 of the frame unit 25 in the first direction X, a coupling unit (not illustrated) coupled to the output shaft 32 of the driving unit 3 is formed. Further, in a second wall unit 27 provided on the other side X2 in the first direction X of the frame unit 25, a shaft unit 28 rotatably supported by the frame 4 is formed.

In the second wall unit 27 of the ice making tray 2, a rotation restriction unit 29 structured to abut against the frame 4 when the ice making tray 2 is rotated around the axis L0 is formed. The ice maker 1 causes the ice making tray 2 to perform the twist operation by the rotation restriction unit 29 preventing the rotation of the ice making tray 2. The rotation restriction unit 29 protrudes from the second wall unit 27 to the other side X2 in the first direction X. On the one side Z1 (upper side) of the rotation restriction unit 29 in the third direction Z, a water receiving unit 30 structured to receive water supplied to the ice making tray 2 via a water channel 10 of the frame 4 is formed. The water receiving unit 30 communicates with the water storage concave units 20 via a cutout of the frame unit 25.

In the ice making tray 2, convex units 21 reflecting the shape of the water storage concave units 20 are arranged on a lower surface 2*a* facing the other side Z2 in the third direction Z. A thermistor (not illustrated) structured to sense a temperature of the ice making tray 2 is arranged on the lower surface 2*a* of the ice making tray 2. The thermistor is covered with a cover 9 (see FIG. 3) fixed to the lower surface 2*a* of the ice making tray 2.

(Driving Unit)

As illustrated in FIG. 2 and FIG. 5, the driving unit 3 includes a casing 31 formed in a cuboid shape. The casing 31 houses a motor (not illustrated) serving as a drive source, a rotation transmission mechanism (not illustrated) structured to transmit the rotational force of the motor, and a cam gear 33 to which the rotational force of the motor is transmitted by the rotation transmission mechanism. The cam gear 33 is integrally formed with the output shaft 32 to which the ice making tray 2 is coupled. The output shaft 32 protrudes outward of the casing 31 from a hole provided in an end plate 311 of the casing 31 on the other side X2 in the first direction X. In order to remove the ice from the ice making tray 2, the output shaft 32 rotates in the CCW direction being a counterclockwise direction around the axis L0 to rotate the ice making tray 2 from the water storage position 2A to the ice removal position 2B. Further, in order to return the ice making tray 2 from the ice removal position 2B to the water storage position 2A, the output shaft 32 rotates in a CW direction being a clockwise direction.

An ice detecting lever 6 is arranged at a position adjacent to the ice making tray 2 on the other side Y2 in the second direction Y. An ice detecting mechanism for operating the ice detecting lever 6 to rotate around an axis L1 in conjunction with the cam gear 33 according to a rotation angle of the cam gear 33, a switching mechanism for operating based on a signal input from thermistor, and the like, are configured in the casing 31 of the driving unit 3. Further, the driving unit 3 is connected to a wire 5 for power supply to the motor. The wire 5 is drawn to the outside of the frame 4 from one side Y1 in the second direction Y of the driving unit 3, and extends along the outer surface of the frame 4 to the other side X2 in the first direction X.

(Frame)

As illustrated in FIG. 1 to FIG. 5, the frame 4 includes the first side plate unit 41 extending in the first direction X on the one side Y1 in the second direction Y of the ice making tray 2 and the driving unit 3, and the second side plate unit 42 extending in the first direction X on the other side Y2 in the second direction Y of the ice making tray 2 and the driving unit 3. The first side plate unit 41 and the second side plate unit 42 face each other in the second direction Y. A first upper plate unit 410 is provided at the upper end of the first side plate unit 41. The first upper plate unit 410 protrudes toward the second side plate unit 42 to the other side Y2 in the second direction Y. Specifically, the first upper plate unit 410 is bent downward at a position halfway to the other side Y2 in the second direction Y and then protrudes toward the second side plate unit 42. Further, from the vicinity of the upper end of the second side plate unit 42, a second upper plate unit 420 protrudes toward the first side plate unit 41.

A substantially rectangular opening 430 is formed between the first upper plate unit 410 and the second upper plate unit 420. The water storage concave units 20 of the ice making tray 2 are open toward the opening 430. The ice detecting lever 6 is arranged between the second side plate unit 42 and the ice making tray 2. In the second upper plate unit 420, an opening 421 in which the upper end of the ice detecting lever 6 is arranged is formed.

Further, the frame 4 includes a first wall unit 43 that extends in the second direction Y and connects ends of the first side plate unit 41 and the second side plate unit 42 on the one side X1 in the first direction X, and a second wall unit 44 that extends in the second direction Y and connects ends of the first side plate unit 41 and the second side plate unit 42 on the other side X2 in the first direction X. A support unit 45 protrudes from the upper end of the first wall unit 43 toward the second wall unit 44. The driving unit 3 is arranged below the support unit 45 and supported by the support unit 45.

The second wall unit 44 is a porous wall in which a plurality of plate-shaped ribs are coupled to each other. A shaft hole 440 structured to rotatably support the shaft unit 28 of the ice making tray 2 is provided in the center of the second wall unit 44. Further, on the upper side of the second wall unit 44, a water channel component 46 is provided. The water channel component 46 protrudes from the second wall unit 44 to the one side X1 and the other side X2 in the first direction X. The water channel component 46 includes the water channel 10 on the top surface thereof. Water poured to the water channel 10 from the water supply pipe (not illustrated) is poured from a water flow port 11 (see FIG. 5) provided at the end of the water channel 10 on the one side X1 in the first direction X to the water receiving unit 30 of the ice making tray 2.

As illustrated in FIG. 3 and FIG. 4, in the second wall unit 44, there is provided an abutment unit 70 structured to abut against the rotation restriction unit 29 of the ice making tray 2 from the front in the CCW direction when the ice making tray 2 rotates around the axis L0 from the water storage position 2A in the CCW direction to reach the ice removal position 2B. The abutment unit 70 protrudes from the second wall unit 44 to one side X1 in the first direction X. In the ice removal position 2B, the abutment unit 70 abuts against the rotation restriction unit 29 and prevents the rotation of the ice making tray 2 that is driven in the CCW direction. As a result, the ice making tray 2 is twisted.

(First Side Plate Unit)

As illustrated in FIG. 2, the first side plate unit 41 includes an inner wall 50 facing the side on which the ice making tray 2 is located (the other side Y2 in the second direction Y). The inner wall 50 has a first inner wall portion 51 extending in the first direction X along the driving unit 3, a second inner wall portion 52 extending in the first direction X along the ice making tray 2 on the other side Y2 in the second direction Y with respect to the first inner wall portion 51, and a step unit 53 extending in a direction intersecting the first direction X and connecting the first inner wall portion 51 and the second inner wall portion 52. As illustrated in FIG. 2 and FIG. 5, a cutout 47 obtained by cutting a lower end of the step unit 53 (an end on the other side Z2 in the third direction Z) upward is formed in the first side plate unit 41. The cutout 47 penetrates the first side plate unit 41. The wire 5 connected to the driving unit 3 is drawn out from the cutout 47 to the outside of the frame 4.

As illustrated in FIG. 3 to FIG. 5, the first side plate unit 41 includes an outer wall 60 facing the opposite side (the one side Y1 in the second direction Y) to the ice making tray 2. The outer wall 60 includes reinforcing ribs 61 that protrude from the inner wall 50 to the one side Y1 in the second direction Y (outside of the frame 4). The reinforcing ribs 61 include a plurality of longitudinal ribs 62 extending in the third direction Z and a plurality of transverse ribs 63 extending in the first direction X. At the outer peripheral edge of the outer wall 60, the longitudinal ribs 62 and the transverse ribs 63 are connected to each other in a frame shape. The tip end surfaces of the longitudinal ribs 62 and the plurality of transverse ribs 63 are located on the same plane, and constitute a grid-like attachment flat surface 64. The attachment flat surface 64 is a surface that abuts against a support (refrigerator) when the ice maker 1 is attached to the support.

The transverse ribs 63 include an upper rib 631 extending in the first direction X along the upper end of the first side plate unit 41, a lower rib 632 extending in the first direction X along the lower end of the first side plate unit 41, and two middle ribs 633 and 634 located between the upper rib 631 and the lower rib 632. Further, among the longitudinal ribs 62, some of the longitudinal ribs 62 located on the one side X1 in the first direction X with respect to the cutout 47 of the first side plate unit 41 extend from the upper end to the lower end of the first side plate unit 41, and are connected to the upper rib 631 and the lower rib 632. Further, among the plurality of longitudinal ribs 62, some of the longitudinal ribs 62 located on the other side X2 in the first direction X with respect to the cutout 47 extend from the upper end of the first side plate unit 41 to the position of the lower middle rib 633, and are connected to the upper rib 631 and the lower middle rib 633. Between the lower middle rib 633 and the lower rib 632, a groove-shaped wire arrangement unit 65 extending from the cutout 47 to the other side X2 in the first direction X is formed.

In the first side plate unit 41, a plurality of attachment units 48 for fixing the frame 4 to the support (not illustrated) when the ice maker 1 is installed in the refrigerator is provided. The attachment units 48 have two types: a first attachment unit 481 protruding upward (the one side Z1 in the third direction Z) from the upper rib 631 located at the upper end of the outer wall 60, and a second attachment unit 482 protruding to one side X1 in the first direction X from the longitudinal rib 62 located at the end of the outer wall 60 on the one side X1 in the first direction X. On the other side X2 in the first direction X with respect to the cutout 47, the first attachment unit 481 is provided in two places separated in the first direction X. Further, the second attachment unit 482 is provided in one place.

The first attachment unit 481 has a vertically long shape in which the height in the third direction Z is longer than the width in the first direction X. A through hole 481*a* for passing a fixing screw is formed at the upper end of the first attachment unit 481. Further, attachment unit reinforcing ribs 483 protruding to the one side Y1 in the second direction Y are formed in the first attachment unit 481. The attachment unit reinforcing ribs 483 are grid-like, and are connected to the reinforcing ribs 61 of the outer wall 60. The second attachment unit 482 is rectangular, in which a through hole 482*a* for passing a fixing screw is formed at the center.

The through hole 481*a* of the first attachment unit 481 has a shape which is enlarged downward from the hole for fixing a screw. Therefore, the screw is passed through the through hole 481*a*, and then the frame 4 is moved downward so that the screw is positioned at the upper end portion of the through hole 481*a*, thereby making it possible to position the frame 4 in the first direction X and the up-down direction. After positioning, the frame 4 is fixed to the refrigerator as the support by fixing a screw in the through hole 482*a* of the second attachment unit 482.

As described above, in the first side plate unit 41, there is provided the cutout 47 (through unit) penetrating the step unit 53 of the inner wall 50, and in the outer wall 60, there is provided the wire arrangement unit 65 extending in the first direction X to communicate with the cutout 47. The wire arrangement unit 65 is a groove surrounded by the lower middle rib 633, the inner wall 50, and the lower rib 632, and opens to the one side Y1 in the second direction Y. The wire arrangement unit 65 is formed in a gap between the middle rib 633 and the lower rib 632, which are the reinforcing rib 61 of the first side plate unit 41.

At the lower edge of the wire arrangement unit 65, wire support units 49 structured to support the wire 5 from the one side Y1 in the second direction Y are provided. The wire support unit 49 protrudes upward (the one side Z1 in the third direction Z) from the tip end of the lower rib 632 extending along the lower end of the outer wall 60. The wire support unit 49 has a plate shape, and a gap in which the wire 5 is held is formed between the wire support unit 49 and the inner wall 50. In the present embodiment, the frame 4 is made of resin, and the wire support unit 49 is elastically deformable in the second direction Y. Accordingly, the wire support unit 49 elastically presses the wire 5 against the inner wall 50. Further, at the tip end portion of the wire support unit 49, a retaining claw 491 bent toward the other side Y2 in the second direction Y is provided.

The wire support units 49 are arranged at two places separated in the first direction X. In the present embodiment, the positions of the two wire support units 49 in the first direction X are substantially the same as those of the first attachment units 481. The wire support unit 49 does not protrude toward the one side Y1 in the second direction Y of the reinforcing rib 61. Therefore, even if the wire 5 is passed between the inner wall 50 and the wire support unit 49, the wire 5 does not protrude toward the one side Y1 in the second direction Y of the reinforcing rib 61. For this reason, even if the wire 5 is drawn along the outer wall 60 of the first side plate unit 41, the floating of the frame 4 due to the wire 5 is less likely to occur when the frame 4 is attached to the refrigerator.

(Cutout)

Figure 6:
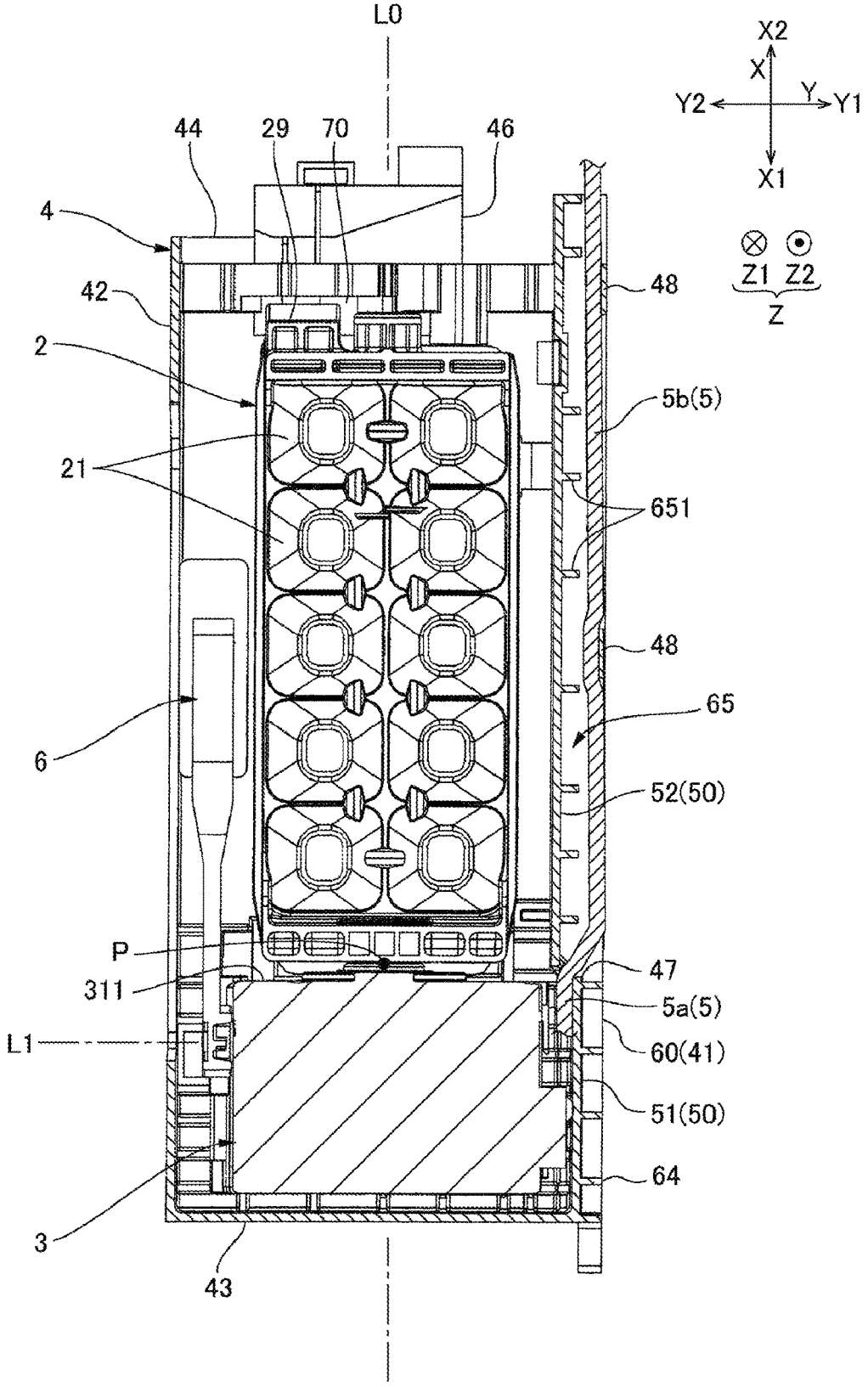
FIG. 6 is a cross-sectional view of the ice maker of FIG. 1 taken at a position of a wire arrangement unit.

FIG. 6 is a cross-sectional view of the ice maker 1 of FIG. 1 taken at a position of the wire arrangement unit 65. As illustrated in FIG. 6, the cutout 47 through which the wire 5 passes is provided by utilizing the step between the first inner wall portion 51 and the second inner wall portion 52 of the inner wall 50, and is formed to penetrate the step unit 53 (see FIG. 2) connecting the first inner wall portion 51 and the second inner wall portion 52. When the cutout 47 is provided in the step unit 53, the opening direction of the cutout 47 becomes the first direction X. Therefore, when the wire 5 is passed through the cutout 47 and drawn out to the other side X2 in the first direction X, the wire 5 can be shaped so as not to be bent greatly.

The cutout 47 is located on the one side Y1 in the second direction Y of a coupling position P at which the driving unit 3 and the ice making tray 2 are coupled to each other, and the coupling position P and the cutout 47 are located at approximately the same position in the first direction X. Accordingly, the first inner wall portion 51 extends along the driving unit 3, and the second inner wall portion 52 extends along the ice making tray 2. The width of the ice making tray 2 in the second direction Y is smaller than the width of the driving unit 3 in the second direction Y, and there is space on both sides in the width direction (second direction Y) of the ice making tray 2. In the present embodiment, the second inner wall portion 52 is offset to the ice making tray 2 side (the other side Y2 in the second direction Y) by utilizing the space between the first side plate unit 41 and the ice making tray 2.

Thus, positioning the second inner wall portion 52 closer to the ice making tray 2 (the other side Y2 in the second direction Y) than the first inner wall portion 51 results in an increased thickness of the first side plate unit 41 in the second direction Y. Specifically, the protrusion dimension of the reinforcing rib 61 on the outer wall 60 side is longer by the offset of the second inner wall portion 52. Therefore, the strength of the first side plate unit 41 can be increased as much as the increased thickness of the first side plate unit 41. In addition, since the cutout 47 is provided on the one side Y1 in the second direction Y with respect to the coupling position P or in the vicinity of the coupling position P, the first side plate unit 41 has an increased thickness over the entire portion extending along the ice making tray 2.

The wire 5 is held by the cutout 47 on the one side Y1 in the second direction Y with respect to the coupling position P. The wire 5 has a first drawing portion 5*a* arranged on the one side X1 in the first direction X with respect to the cutout 47 and a second drawing portion a arranged on the other side X2 in the first direction X with respect to the cutout 47. The first drawing portion 5*a* is arranged between the driving unit 3 and the first inner wall portion 51. The second drawing portion a is arranged in the wire arrangement unit 65. In the wire arrangement unit 65, there are provided a plurality of small-sized reinforcing ribs 651 protruding from the second inner wall portion 52 to the one side Y1 in the second direction Y. The small-sized reinforcing rib 651 has a smaller protrusion dimension from the first inner wall portion 51 than the reinforcing rib 61. Accordingly, a gap for holding the second drawing portion 5*b* of the wire 5 is formed between the wire support unit 49 and the tip end of the small-sized reinforcing rib 651.

(Operation)

In the ice maker 1 of the present embodiment, the frame 4 is fixed to the refrigerator serving as the support by three attachment units 48, and the ice maker 1 is then installed in the refrigerator. In this state, ice making is performed in the ice making tray 2. In the ice making process, water is supplied to the ice making tray 2 horizontally arranged so that the water storage concave units 20 face upward through the water supply pipe (not illustrated), and the water storage concave units 20 are filled with water accordingly. Thereafter, the water filled in the ice making tray 2 is cooled by a cooling unit (not illustrated) installed above the ice making tray 2. Whether or not the ice making is completed is determined by thermistor attached to the ice making tray 2 depending on whether the temperature of the ice making tray 2 is equal to or lower than a predetermined temperature.

When the ice making is completed, the ice detecting lever 6 detects the amount of ice in an ice storage container (not illustrated) installed below the ice making tray 2. Specifically, the ice detecting lever 6 is driven by the driving unit 3 to descend. At this time, when the ice detecting lever 6 descends to a predetermined position, it is determined that the inside of the ice storage container is not full of ice. On the other hand, when the ice detecting lever 6 comes in contact with the ice in the ice storage container before descending to the predetermined position, it is determined that the ice storage container is full of ice. When the ice storage container is full of ice, after waiting for a predetermined time, the ice detecting lever 6 detects again the amount of ice in the ice storage container.

When the ice storage container is full of ice, the operation of removing the ices from the ice making tray 2 is performed. Specifically, the rotation of the output shaft 32 of the driving unit 3 causes the ice making tray 2 to rotate around the axis L0. When the rotation of the ice making tray 2 reaches a predetermined rotation angle of 90° or more (for example, 120°) from the home position at which the ice making tray 2 is located horizontally, the rotation restriction unit 29 of the ice making tray 2 abuts against the abutment unit 70 of the frame 4. In this state, even if the ice making tray 2 is further rotated, the rotation is prevented, and the ice making tray 2 is twisted and deformed. As a result, the ice in the ice making tray 2 is peeled off from the ice making tray 2 and drops into the ice storage container installed below the ice making tray 2.

After that, the driving unit 3 reversely rotates the ice making tray 2 so that the water storage concave units 20 face upward, and the above operation is repeated.

(Main Effect of Present Embodiment)

As described above, the ice maker 1 according to the present embodiment includes the ice making tray 2 including the water storage concave units 20 arranged to face upward, the driving unit 3 structured to cause the ice making tray 2 to perform the flip operation and the twist operation around the axis L0 extending in the first direction X, and the frame 4 structured to support the ice making tray 2 and the driving unit 3. The frame 4 includes the first side plate unit 41 extending in the first direction X on the one side Y1 in the second direction Y intersecting the up-down direction and the first direction X (the direction of the axis L0 of the ice making tray 2) with respect to the ice making tray 2. In the inner wall 50 of the first side plate unit 41, there are provided the first inner wall portion 51 extending in the first direction X along the driving unit 3, and the second inner wall portion 52 extending in the first direction X along the ice making tray 2 on the other side Y2 in the second direction Y with respect to the first inner wall portion 51, and in the step unit 53 connecting the first inner wall portion 51 and the second inner wall portion 52, there is provided the cutout 47 serving as the through unit for passing the wire 5 connected to the driving unit 3.

In the present embodiment, since the inner wall 50 of the first side plate unit 41 is shaped to have a step, the thickness of the first side plate unit 41 in the second direction Y is increased by the amount of the step. Therefore, the strength of the first side plate unit 41 can be secured, and deformation or damage of the frame 4 can be suppressed. Further, since the step unit 53 which is a step surface intersects the first direction X, the cutout 47 penetrating the first side plate unit 41 in the first direction X can be provided in the step unit 53. Therefore, when the wire 5 is drawn through the cutout 47 and along the outer side surface of the frame 4, the wire 5 can be drawn so as not to bend greatly. Further, the cutout 47 is provided as the through unit, thereby making easy work of passing the wire 5 through the through unit. It is noted that not the cutout 47 but a hole can also be provided as the through unit.

In the present embodiment, the step unit 53 of the inner wall 50 is located on the one side Y1 in the second direction Y with respect to the coupling position P at which the driving unit 3 and the ice making tray 2 are coupled to each other. Therefore, the first side plate unit 41 has an increased thickness in the second direction Y over the entire portion on the ice making tray 2 side with respect to the coupling position P, thereby making it possible to secure the strength of the first side plate unit 41. Therefore, deformation or damage of the frame 4 can be suppressed. Further, since the thickness of the first side plate unit 41 can be increased by utilizing an empty space around the ice making tray 2, securing the strength of the first side plate unit 41 makes it possible to prevent the size of the ice maker 1 in the second direction Y from increasing.

In the present embodiment, the ice making tray 2 is made of a flexible material, and the frame 4 includes the abutment unit 70 structured to abut against the ice making tray 2 from the side on which the first side plate unit 41 is located when the ice making tray 2 rotates in the CCW direction from the water storage position 2A where the water storage concave units 20 face upward to reach the ice removal position 2B where the water storage concave units 20 face downward, and to prevent the rotation of the ice making tray 2. With such a configuration, when the ice making tray 2 is moved to the ice removal position 2B to remove the ice, a force applied from the ice making tray 2 to the frame 4 is a force to press the first side plate unit 41. Therefore, by increasing the thickness of the first side plate unit 41 in the second direction Y by the amount of the step to secure the strength of the first side plate unit 41, deformation or damage of the frame 4 can be suppressed. Further, the ice removal position 2B is such a position that the opening direction of the water storage concave units 20 of the ice making tray 2 is on the other side Y2 in the second direction Y and that the opening direction of the water storage concave units 20 faces the opposite side to the side on which the first side plate unit 41 is located. Therefore, the ice can be dropped to the opposite side to the side on which the wire 5 is drawn (that is, the side on which the first side plate unit 41 is located).

In the present embodiment, the ice maker 1 is installed so that the first side plate unit 41 abuts against the support (refrigerator). Therefore, the force applied from the ice making tray 2 to the frame 4 is a force to press the first side plate unit 41 against the support, and can support the first side plate unit 41 with the support accordingly. Thus, deformation or damage of the frame 4 can be suppressed.

The ice maker 1 according to the present embodiment includes the second side plate unit 42 extending in the first direction X on the other side Y2 in the second direction Y with respect to the ice making tray 2, and the ice detecting lever 6 (ice detecting member) supported to be movable in the up-down direction is arranged between the second side plate unit 42 and the ice making tray 2. Therefore, the wire 5 can be drawn to the opposite side to the side on which the ice is dropped from the ice making tray 2 (that is, the side on which the ice detecting lever 6 is arranged).

In the present embodiment, the first side plate unit 41 includes the outer wall 60 facing the one side Y1 in the second direction Y, and the outer wall 60 includes the plurality of reinforcing ribs 61 protruding to the one side Y1 in the second direction Y. Therefore, the strength of the first side plate unit 41 can be secured by the reinforcing ribs 61. Further, the tip end surfaces of the plurality of reinforcing ribs 61 are located on the same plane, and constitute the grid-like attachment flat surface 64. Therefore, the ice maker 1 can be installed so that the attachment flat surface 64 abuts against the support and the first side plate unit 41 is supported by the support. Thus, the floating of the frame 4 from the support can be suppressed. In addition, deformation or damage of the frame 4 can be suppressed.

In the present embodiment, the cutout 47 penetrating the step unit 53 is in communication with the wire arrangement unit 65 provided in the gap of the reinforcing ribs 61. Therefore, a space for drawing the wire 5 is secured, thereby making it possible to prevent the wire 5 from jumping outside the reinforcing ribs 61. Therefore, damage to the wire 5 or floating of the frame 4 from the support due to the wire 5 being sandwiched between the first side plate unit 41 and the support can be suppressed.

In the present embodiment, in the outer wall 60 of the first side plate unit 41, there is provided the wire support unit 49 supporting the wire 5 on the other side X2 in the first direction X with respect to the cutout 47 penetrating the first side plate unit 41. Therefore, it is easy to support the wire 5 which is free on the outside of the frame 4. Further, the wire support unit 49 is formed at the edge of the wire arrangement unit 65, thereby making it possible to hold the wire 5 so as to be prevented from jumping outside the wire arrangement unit 65. Therefore, damage to the wire 5 or floating of the frame 4 from the support due to the wire 5 jumped out of the wire arrangement unit 65 being sandwiched between the first side plate unit 41 and the support can be suppressed.

In the present embodiment, since the cutout 47 is provided at the lower end of the first side plate unit 41, the wire 5 can be drawn along the lower end of the first side plate unit 41. Therefore, the wire 5 is unlikely to hinder the installation of the water supply pipe for supplying water to the ice making tray 2 and the like.

What is claimed is:

1. An ice maker comprising:

an ice making tray including a water storage concave unit arranged to face upward;

a driving unit arranged on one side of a first direction and the first direction being along a longitudinal axis of the ice making tray, and the driving unit being structured to cause the ice making tray to perform a flip operation and a twist operation around the longitudinal axis, wherein the driving unit comprises a casing;

a frame structured to support the ice making tray and the driving unit; and a wire passing through a through unit of the frame from the driving unit and drawn out of the frame, wherein the frame includes a first wall unit configured on the one side of the first direction, a second wall unit configured on an opposite side of the first direction and opposite to the first wall unit, a first side plate unit extending in the first direction on one side of a second direction and including an inner wall facing the ice making tray and the driving unit, wherein the second direction intersects the first direction and the first and second directions extend on a same plane, and an up-down direction intersects the plane, and a second side plate unit extending in the first direction is located on an opposite side of the second direction and opposite to the first side plate unit, the inner wall includes a first inner wall portion extending in the first direction along the driving unit, a second inner wall portion extending in the first direction along the ice making tray and being located closer to the opposite side of the second direction with respect to the first inner wall portion, and a step unit extending in a direction intersecting the first direction to connect the first inner wall portion and the second inner wall portion, and the through unit is provided in the step unit.

2. The ice maker according to claim 1, wherein the step unit is located on the one side in the second direction at a coupling position where the driving unit and the ice making tray are coupled to each other.

3. The ice maker according to claim 1, wherein the first side plate unit includes an outer wall, the outer wall includes a plurality of reinforcing ribs protruding toward the one side in the second direction, the through unit is provided in a gap between the reinforcing ribs, and tip end faces of the plurality of reinforcing ribs are located on a same plane, and the tip end faces are an attachment flat surface structured to abut against a support structured to support the ice maker.

4. The ice maker according to claim 1, wherein the driving unit flips the ice making tray from a water storage position where the water storage concave unit faces upward to an ice removal position where the water storage concave unit faces downward, and vice versa, and the ice removal position is a position such that an opening direction of the water storage concave unit faces a side opposite to which the first side plate unit is located.

5. The ice maker according to claim 4, wherein the ice making tray is made of a flexible material, and the frame includes an abutment unit structured to abut against the ice making tray from the side on which the first side plate unit is located when the ice making tray is flipped around the axis to reach the ice removal position from the water storage position and to prevent rotation of the ice making tray.

6. The ice maker according to claim 1, wherein an ice detecting lever supported to be movable in the up-down direction is arranged between the second side plate unit and the ice making tray.

7. The ice maker according to claim 1, wherein the through unit is a cutout provided at a lower end or an upper end of the first side plate unit.

* * * * *